US012201200B1

(12) United States Patent
Nikolaev

(10) Patent No.: US 12,201,200 B1
(45) Date of Patent: Jan. 21, 2025

(54) CARD HOLDER FOR HOLDING AT LEAST ONE CARD

(71) Applicant: Travando GmbH, Nuremberg (DE)

(72) Inventor: Alexander Nikolaev, Nuremberg (DE)

(73) Assignee: TRAVANDO GMBH, Nuremberg (DE)

( * ) Notice: Subject to any disclaimer, the term of this patent is extended or adjusted under 35 U.S.C. 154(b) by 13 days.

(21) Appl. No.: 18/390,504

(22) Filed: Dec. 20, 2023

(30) Foreign Application Priority Data

Oct. 9, 2023 (DE) ..... 10 2023 127 496.1
Oct. 23, 2023 (DE) ..... 20 2023 106 123.0

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/154
See application file for complete search history.

(56) References Cited

U.S. PATENT DOCUMENTS

| | | | | |
|---|---|---|---|---|
| 10,653,222 | B2 * | 5/2020 | Scharnigg | B65D 83/08 |
| 11,234,502 | B2 * | 2/2022 | Van Geer | B65D 83/08 |
| 11,244,093 | B2 * | 2/2022 | Desmeure | G06F 30/23 |
| 2015/0282580 | A1 | 10/2015 | Chen | |

FOREIGN PATENT DOCUMENTS

| | | | |
|---|---|---|---|
| DE | 202008003127 | U1 | 5/2008 |
| EP | 3167744 | A1 | 5/2017 |
| WO | 2014195837 | A1 | 12/2014 |

* cited by examiner

*Primary Examiner* — Sue A Weaver
(74) *Attorney, Agent, or Firm* — LUCAS & MERCANTI, LLP

(57) ABSTRACT

A card holder for holding at least one card corresponding to a credit card format includes a receiving device with a receiving opening and interior. The at least one card can be received in the interior through the receiving opening. The cardholder further includes an ejector arranged in the interior and rotatable about a shaft. An actuator is connected to the ejector and is rotatable with the ejector about the shaft. The at least one card can be moved out of the interior through the receiving opening in response to an actuating movement of the actuator relative to the receiving device from an initial position to an output position.

20 Claims, 7 Drawing Sheets

CARD HOLDER FOR HOLDING AT LEAST ONE CARD

CROSS-REFERENCE TO RELATED APPLICATIONS

The present application claims priority to German patent application 10 2023 127 496.1, filed Oct. 9, 2023 and German Utility Model application 20 2023 106 123.0, filed Oct. 23, 2023.

BACKGROUND OF THE INVENTION

The invention relates to a card holder for holding at least one card, in particular a card corresponding to a credit card format.

Corresponding card holders are devices sometimes also referred to as a wallet or card wallet, which are known in principle from the prior art. In the case of known card holders, a linear actuating movement usually enables cards received in the card holder to be removed in a linear manner. A disadvantage in this case is that a linear actuating movement performed manually be ergonomically unfavorable.

BRIEF SUMMARY OF THE INVENTION

An object of the invention is that of specifying a card holder for holding at least one card, in particular a card corresponding to a credit card format, which allows the user comfortable and simple use, and furthermore provides additional use functions.

The invention is achieved by a card holder for holding at least one card, in particular a card corresponding to a standardized format, such as a credit card format, which card holder comprises a receiving device having a receiving opening and an interior, wherein at least one card can be received, in particular completely, in the interior via the receiving opening. The interior of the card holder can be designed for example in such a way that at least two cards, preferably at least four cards, particularly preferably at least seven cards, can be received, wherein the cards in particular have a format of a credit card. The cards received in the interior can directly touch adjacent cards, such that no receiving pocket needs to be provided in the interior for receiving respective cards, which leads to a better use of space of the interior and/or more cards can be received in the interior than if receiving pockets for receiving one card in each case were arranged or formed in the interior. Optionally, the receiving opening can be dimensioned such that at least two, preferably at least four, particularly preferably at least six, most preferably at least seven, cards can be moved through the receiving opening simultaneously. For example, all the cards located in the interior can be introduced or removed simultaneously or in a temporarily offset manner, at least in portions, through the receiving opening.

Furthermore, the card holder comprises at least one ejection means which is arranged in the interior and is mounted so as to be rotatable, in particular indirectly or directly, about a shaft. In other words, the ejection means is mounted on the card holder in such a way, in particular on a receiving device of the card holder in such a way that the ejection means performs a rotational movement about at least one shaft at least in portions, preferably largely, particularly preferably exclusively. In this case, the ejection means can for example be mounted so as to be rotatable about a single shaft. Optionally, the ejection means can perform a movement which is performed at least in portions about a first rotational shaft and at least in portions about a second rotational shaft. The ejection means can also for example perform a movement which comprises translational and rotational movement components, e.g. this can be achieved by means of a slotted guide. The at least one rotational shaft, in particular the single rotational shaft, about which the actuation means can be twisted relative to the receiving device, can be designed so as to be perpendicular to an, in particular linear, insertion and/or removal direction of at least one card received in the interior of the receiving device. According to the figures, an insertion and/or removal movement of a card takes place along the Y-axis, wherein the rotational shaft extends along the Z-axis or rotates about the Z-axis which is oriented perpendicularly to the Y-axis. Accordingly, the recess of the front element, in particular the edges defining the recess of the front element can be formed, at least in portions, preferably largely, particularly preferably completely, as a guide or slotted guide for a portion of the actuation means and/or of the ejection means arranged in the recess. In particular, at least one boundary edge of the recess can form a stop, in particular an end stop, for a portion of the actuation means and/or of the ejection means moving in the recess.

The card holder furthermore comprises at least one actuation means which is connected, in particular motion-coupled, to the ejection means and is mounted so as to be rotatable about a shaft, wherein at least one card arranged in the receiving device being able to be moved out of the interior, at least in part, via the receiving opening, by performing an actuating movement of the actuation means relative to the receiving device from an initial position to an output position. The actuation means forms for example a grip or a contact point on which for example at least one finger of a person rests while the person exerts a pressure force on the actuation means for performing the actuating movement. The actuating movement of the actuation means relative to the receiving device, initiated by the person by means of muscle power, results in a forced movement of the ejection means for moving the at least one card out of the interior of the receiving device. For example, by means of a manual introduction of force on the actuation means, said means is rotated relative to the receiving device about a shaft. During said rotational movement of the actuation means about the shaft, on account of a motion coupling or a motion-coupled connection of the ejection means and actuation means, a rotational movement of the ejection means takes place, in particular about the same (rotational) shaft. Said rotational movement of the ejection means leads to an application of compressive force, in particular taking place directly by the ejection means, on the at least one card received or stored in the interior, such that said card performs a linear movement within the interior and is then guided out of the interior and in the process out of the receiving opening, at least in portions.

In one embodiment, the ejection means is fastened in a stationary manner relative to the actuation means. In other words, the ejection means cannot perform a relative movement with respect to the actuation means, and/or the ejection means can form a rigid connection with the actuation means. Preferably, the ejection means is connected to the actuation means in a torsion-proof manner. For this purpose, the ejection means can be fastened to the actuation means for example by means of two fastening elements, e.g. two screws.

It is possible for the receiving device to have a prismatic basic shape, in particular a cuboid basic shape, and for the actuation means to be designed as a planar body, wherein a main extension surface of the actuation means is of a size which corresponds at least to 35%, preferably to at least 50%, particularly preferably to at least 75%, most preferably to at least 85%, more preferably completely, to the size of a main extension surface of the receiving device. In other words, a planar or elongate extension of the actuation means and the receiving device can be matched to one another in such a way that the actuation means covers a side of the receiving device to at least 35%, preferably at least 50%, particularly preferably at least 75%, most preferably at least 85%, more preferably completely. For example, a main extension plane and/or main extension surface of the actuation means is arranged or oriented in parallel with a main extension plane and/or main extension surface of the receiving device.

It is possible for (a) the actuation means to be arranged, in the initial position, in particular in a rest position, so as to be largely, preferably completely, congruent with a main extension surface of the receiving device, and/or for (b) the actuation means, in the output position, to protrude from a main extension surface of the receiving device, at least in part. Due to the temporary overhang of the actuation means in the state of the output position, a user of the card holder or a third party observing the card holder can optically and/or haptically unambiguously and clearly detect the output position state on account of the increase in surface area of the card holder. Therefore, this state can be haptically clearly and unambiguously perceptible for a user of the card holder. In the initial state or in the rest state, the card holder has a compact form compared with the output position state.

In an optional embodiment, it can be provided that the actuation means protrudes beyond a main extension surface of the receiving device in at least one position, rotated out of the initial position, in particular a rest position, relative to the receiving device, preferably an output position, particularly preferably in an end state position achieved in an end state of the actuating movement, wherein a surface portion of the main extension surface of the actuation means which protrudes beyond the main extension surface of the receiving device in this case, is substantially in the shape of a trapezium. The protruding surface portion of the main extension surface of the actuation means can have said trapeze shape at least after executing at least 40%, preferably at least 50%, particularly preferably at least 75%, most preferably at least 85%, more preferably a least 95% of the maximum possible movement path proceeding from the initial position to the end state position. In other words, in this embodiment the pivoting-up movement of the actuation means is limited by a stop, wherein the maximum movement path extends from the initial position (in which the actuation means is congruent with the receiving device) to the output position. In this embodiment, the trapezium shape assumed by the protruding surface portion of the actuation means is such that it comprises two opposing sides oriented in parallel with one another, and two further opposing, non-parallel sides. In other words, the trapezium shape forms the planar basic shape of a quadrilateral having four sides, wherein a first pair of sides is oriented in parallel with one another and a further pair of sides is not oriented in parallel with one another. Alternatively or in addition, the protruding surface portion of the actuation means can be shaped such that it forms a quadrilateral which has a right-angle between one side and the respectively adjacent sides, and has an angle different from 90° in each case in the corners transitioning from the respective adjacent sides to a connecting side. The actuation means for temporarily forming the trapezoidal surface portion can have for example the basic shape of a rectangle or a square, in particular with respect to its main extension surface.

A stop which limits the maximum rotational movement of the actuation means relative to the receiving device can for example comprise a resilient means. For example, one contact partner of the stop for the rotational movement of the actuation means relative to the receiving device can comprise an elastomer or similar resilient material, and/or be formed at least in portions in such a way that it has resilient properties. For example, a resilient element can be formed on the intermediate element and/or on the ejection means, in order to allow for a damped stop in the case of maximum twisting of the actuation means relative to the receiving device.

In an optional embodiment, the actuation means can protrude beyond a main extension surface of the receiving device in at least one position rotated out of an initial position, relative to the receiving device, i.e. in an output position, wherein a surface portion of the actuation means which protrudes beyond the main extension surface of the receiving device in this case corresponds to at least 10%, preferably at least 20%, particularly preferably at least 35%, most preferably at least 50%, of the main extension surface of the actuation means. The protruding surface portion of the actuation means and the main extension surface of the receiving device can for example each be in a plane which is (in each case) perpendicular to the shaft about which the actuation means performs its rotational movement relative to the receiving device. The projecting surface portion considered is typically that which results in the case of the maximum possible outwards movement of the cards and/or which results in the case of the maximum possible deflection or in the case of twisting of the actuation means and receiving device.

It is possible for the card holder to comprise a preload means which preloads or pushes the actuation means, relative to the receiving device, into the initial position, by means of a preload force. Preferably, the preload means is configured as a tension or compression spring, and can thus form a spring preload means. The preload means allows a constantly defined position of an actuation means that is not actuated manually, irrespective of whether a card is arranged in the interior. The preload means can act indirectly or directly on the actuation means. It is possible for the preload means to act directly, i.e. with direct contact, on the ejection means or to touch the ejection means directly. For example, the preload means can be fastened at one end to a portion of the receiving device and at the other end to the ejection means, in particular directly in each case.

In a further optional embodiment, the card holder can comprise a magnet device, wherein the magnet device moves or preloads or pushes the receiving device and the actuation means towards one another, in at least one predefined orientation, on account of magnetic forces. Said predefined orientation of the receiving device and actuation means, achieved by means of the magnet device, preferably corresponds to the initial position, or the elements are moved or pushed into said position, i.e. for example into the rest position of the card holder. In the rest position, typically no forces generated by a person via direct contact with the card holder act on the actuation means. For example, in order to achieve the initial position, in particular the rest position, or in order for the actuation means and receiving device to remain in the initial position, in particular rest position, the magnet device and the preload means, in particular comprising a spring, or spring preload means, act simultaneously, such that for movement out of the initial position or rest position an actuation force is to be applied which at least temporarily exceeds the retaining force, resulting from the preload means or spring preload means and the magnet device. The magnet device can for example comprise magnet pairs consisting of two magnet elements in each case. In this case, a first magnet element of a first magnet pair can be arranged or formed, in particular directly, in or on the actuation means, and a second magnet element of the first magnet pair can be arranged or formed in or on the receiving device.

The magnet device can comprise at least one pair of magnet elements, wherein a first magnet element of the first pair is arranged or formed on the actuation means, and a second magnet element of the first pair, associated with the first magnet element, is arranged or formed on the receiving device. The magnet device preferably comprises a further pair of magnet elements, wherein a third magnet element (which is associated with a second pair) is arranged or formed on the actuation means, and a fourth magnet element associated with the third magnet element (which is associated with the second pair) is arranged or formed on the receiving device. Both pairs of magnet elements in each case preload the receiving device and the actuation means in the same position and/or orientation, preferably in the initial position of the receiving device and actuation means or push the receiving device and the actuation means into the same position and/or orientation. If the card holder comprises two pairs of magnet elements for preloading the actuation means and receiving device into the same position, the two pairs can be arranged or formed on two opposite end regions of the actuation means. For example, a first pair can be arranged or formed on a first longitudinal and/or transverse-side end region of an elongate actuation means and/or of an elongate receiving device, and a second pair can be arranged or formed on a longitudinal and/or transverse-side end region of the actuation means and/or of the receiving device opposite the first end region. On account of the fact that the magnet elements are spaced apart from one another to such an extent, holding of the position of the actuation means and receiving device, preloaded by the magnet pair, against an external action of force can be achieved in an effective and defined manner.

The magnet device and the preload means, in particular spring preload means, can for example act on the actuation means and the receiving device in such a way as to achieve that the actuation means and receiving device reach and/or remain in the initial position, in particular in the rest position. In other words, two different action mechanisms (magnetic force or spring force) can be used for generating a resulting force, in particular a restoring force. Said resulting force and/or said restoring force can for example act together on a target orientation or a target position of the actuation means and receiving device. A rest position typically refers to a positioning of the actuation means and receiving device which is set or results if no external, i.e. for example manual, forces act on the card holder.

The receiving device can for example comprise a plate-like front element and a plate-like rear element, as well as an in particular planar intermediate element arranged between the front and the rear element, wherein the intermediate element is U-shaped, and the interior is formed or delimited by the intermediate element and the adjacent front and rear element. The front element and/or the rear element and/or the intermediate element can for example be formed as an integral element. For example, the front and/or rear element can be designed as a metal plate. The intermediate element can be formed in one piece or in multiple parts. For example, the intermediate element may have been produced, at least in its basic shape, particularly preferably completely to its target shape, in a primary shaping or reshaping or machining manufacturing method. The intermediate element can for example consist of metal and can preferably have been produced in a machining method and/or in a casting method. Alternatively, the intermediate element can be formed of plastics material and have been produced for example in the course of a plastics injection molding method.

At least one magnet element of the magnet device can be arranged for example at, e.g. on or in, a free limb of the U-shaped intermediate element. A first magnet element can be arranged e.g. at a first free limb and, and a second magnet element can be arranged at, e.g. on or in, a second free limb of the U-shaped intermediate element. For example, the receiving device comprises a U-shaped frame body, wherein said body comprises two free limbs, in particular oriented in parallel with one another, and a connecting limb that connects the two free limbs. Preferably (in each case) at least one magnet element is arranged or formed on at least one free limb, particularly preferably on one free limb in each case. The at least one magnet element can be fastened to the receiving device, in particular to an intermediate element on the receiving device side, by means of a force-fitting and/or form-fitting and/or integral connection. For example, at least one magnet element can be received in a receiving space of the intermediate element, forming a clamping connection.

The receiving device can for example comprise a plate-like front element which is arranged or formed between the interior and the actuation means, wherein the actuation means covers, in particular completely, a surface portion of the front element in the initial position, and the surface portion of the front element is exposed at least in portions, preferably largely, while the actuating movement is performed. In this case, the actuation means can be pivoted out relative to the front element, in such a way that a surface area of the surface portion of the front element is exposed which corresponds to at least 10%, preferably at least 25%, particularly preferably at least 35%, most preferably at least 40%, more preferably at least 50%, of the surface area of a credit card. Said receiving device or the interior thereof can be designed in such a way that typically, in particular maximally, cards in a credit card format can be received.

The surface portion of the front element which is exposed in the actuation state can for example be used for making notes on the surface portion, e.g. by means of a pencil or another writing implement. Said notes are then covered by the actuation means in the initial position of the actuation means, and thus protected from mechanical influence or from mechanical contact with a third object. In this case, it may be advantageous for the exposed surface portion to at least largely, preferably to at least 75%, particularly preferably to at least 85%, form a closed, and in particular planar, surface. Thus, notes can be made in a simple and comfortable manner.

Advantageously, the actuation means can be held in at least one output position rotated out of the initial position, in particular in the maximally rotated-out end state position, by a holding device, in the rotated-out output position, against a preload force generated by a preload means, in particular a spring preload means, which preloads the actuation means into the initial position. Thus, in the state of the exposed surface portion, a latching or holding of this state can be provided, such that a note can be applied to the exposed surface portion without having to apply an active counter-force against the preload force. The holding means can comprise a trigger mechanism which can be switched between a holding state and a release state for indirectly or directly holding the actuation means in the output position and against a preload force of a preload means. Alternatively, the holding device can be designed as a latching mechanism, such that a predefined latching force has to be overcome in order to reach and/or to leave a position to be held or a holding position of the actuation means. The latching mechanism or the holding device can be formed by a holding structure that is arranged or formed on the actuation means and/or on the ejection means and/or on the receiving device.

For example a, in particular a single, recess can be formed in the front and/or in the rear element, in which recess a connection region on the actuation means side for connecting the actuation means to the ejection means is arranged, and/or in which recess a connection region on the ejection means side for connecting the actuation means to the ejection means is arranged. For example, the recess is in the shape of at least one circle segment or in the shape of a least one annular segment. The recess can in principle be designed in the manner or form of a slot. In this case, the radial extension (width) of the circle segment or of the annular segment from a center point of the (rotational) shaft can substantially correspond to the radial extension of the connection region on the actuation means side and/or on the ejection means side. For example, the extension width of the annular segment or circle segment can be at most 150%, preferably 125%, particularly preferably 110%, most preferably 105%, of the width extension of the connection region.

It is possible for the ejection means to be connected to the receiving device in a supporting manner exclusively via the actuation means. In this case, a connection of the ejection means to the receiving device achieved via a preload means, in particular via a spring preload means, or via any magnet elements, cannot be understood as a supporting connection. The rotatable mounting of the ejection means can be achieved exclusively by means of a pivot bearing, which rotatably mounts the actuation means and the receiving device to one another. It can also be provided for no direct mounting of the ejection means on the receiving device to be provided, but rather for the ejection means to be connected to the receiving device exclusively via the actuation means. In other words, the ejection means does not comprise a direct mounting point with the receiving device, but rather the ejection means is mounted via a pivot bearing which, in particular directly, rotatably connects the actuation means to the receiving device. The pivot bearing can for example be arranged or formed in a corner region of a receiving device having a prismatic basic shape, wherein the pivot bearing extends perpendicularly to the main extension plane of the receiving device. In this case, the pivot bearing can be located exclusively in a surface region of a main extension plane of the prismatic basic shape, wherein said surface region is located within 25% of the length and width associated with the corner region, proceeding from the total length and total width of the receiving device.

In a preferred embodiment, a form-fitting connection of the actuation means on the receiving device is achieved exclusively via a bearing pin and an engagement of the connection region and of the ejection means in the recess of the front and/or rear element. Furthermore, a magnet device can optionally act as a force-fitting connection component between the actuation means and the receiving device, and/or a preload means between the ejection means and the receiving device.

The ejection means can for example comprise a stepped contact portion for contact of at least two cards received in the interior, wherein during the actuating movement the stepped contact portion moves the at least two cards out in a stepped form. The stepped form of the contact portion thus leads to a stepped arrangement of the cards pushed out of the interior using the ejection means. The stepped form of the contact portion or the stepping thereof can be designed so as to be uniform or non-uniform. Thus, for example, a non-uniform stepping can be achieved in that individual cards are lifted out at different spacings from adjacent cards. For example, a card located closer to the actuation means is lifted out to a lesser extent than a card adjacent thereto. It can also be provided that a group of card places and their corresponding stepping of the ejection means is configured in such a way that the cards of said card places have a first moving-out length difference, and said moving-out length difference is larger by at least the factor 1.05, preferably 1.2, particularly preferably at least 1.5, most preferably at least 1.75, more preferably at least 2.0, than the moving-out length difference of two adjacent cards of a second group of card places and their ejection means associated therewith.

The receiving device can for example comprise a retaining device which forms a force-fitting connection between at least one card introduced into the interior and the receiving device. The retaining device can comprise at least one resilient retaining element, which is connected in a force-fitting, integral and/or form-fitting manner to the receiving device Thus, for example, a first resilient retaining element can be arranged or formed on a first free U-shaped limb of the intermediate element, and a second resilient retaining element can be arranged or formed on a second free U-shaped limb of the intermediate element. Preferably, the at least one free retaining element is arranged closer to a free end of a free U-shaped limb of the intermediate element than a magnet element that is arranged at, in particular in or on, the same free U-shaped limb. The retaining device can preferably ac on a card inserted into the interior of the receiving device in such a way that said card does not fall or move out of the interior of the card holder due to gravity, even when the receiving device is placed upside-down. The retaining device can preferably act, in an integral or clamping manner, directly on a card inserted into the interior.

For example, the retaining device comprises at least one retaining element which contacts a card, introduced into the interior, at a long narrow side of the card. The cards received in the interior are preferably touched by retaining elements on two opposing narrow sides, preferably on two opposing longitudinal narrow sides.

It may prove advantageous for the retaining device to comprise at least one pressing device which makes it possible to press at least one card, received in the interior, against a longitudinal surface of the interior of the card holder. In particular if the interior is not completely filled with cards it may be the case, while the cards are being pushed out by the ejection means, that the sides of the cards facing the ejection means perform an evasion movement. Such an evasion movement of the cards while the ejection means acts thereon is reduced or prevented by means of the pressing, assisted by the pressing device, of the cards, received in the interior, onto a longitudinal surface of the interior. In other words, the pressing device can be designed to contact the cards introduced into the interior, indirectly or directly, via further cards introduced into the interior, by contact on a main extension surface of the at least one card, and to move or hold said cards into or in a defined location within the interior.

It is optionally possible for the card holder to comprise a closure device which comprises a least one closure element that can be moved between a closure position which closes the receiving opening at least in portions and a release position which releases the receiving opening. The opening of the interior can be closed by the closure device in such a way that unintentional moving out of cards received in the interior, in particular of cards in the form of a credit card or similar cards, is prevented. The closure element can be mounted on the receiving device so as to be linearly movable and/or rotatable, and/or the at least one closure means can perform a rotational and/or linear movement in order to reach the release position and/or to reach the closed position. The closure means can be arranged or formed, in particular rotatably mounted, for example on a portion of the front and/or rear element of the receiving device facing the receiving opening.

The card holder can for example have a rectangular base surface, wherein a form-fitting connection of the actuation means and the receiving device is formed or arranged exclusively at a corner region of the rectangular base surface, and the actuation means together with the receiving device forms a separation gap. In other words, the actuation means is indirectly or directly connected, in a form-fitting manner, to the receiving device exclusively via a connection point or a rotary joint, wherein any further connections of the actuation means to the further components of the card holder can be achieved via a force-fitting connection, e.g. by means of magnetic forces. This makes it possible that a piece of paper or another planar element can be placed in the separation gap (gap space) between the actuation means and the receiving device, in particular between the actuation means and a front disk or front plate of the receiving device facing the actuation means. For example, a banknote or another piece of paper, e.g. a business card, can be placed in the gap space or be clamped in by means of a magnetic force that attracts actuation means to the receiving device in the region of the gap space. On account of the fact that the gap space has an interference geometry merely at one (single) corner region, or the gap space extends up to the one (single) corner region, there is a correspondingly larger holding space for the clamping or holding of planar elements within the gap space. A larger clearance or gap space also allows for there to be a large number of access options for sliding a planar element into the gap space. The gap space or the separation gap can extend over at least 50%, preferably at least 75%, particularly preferably at least 85%, most preferably at least 90%, of the main extension surface of the receiving device and/or of the actuation means.

It is possible that a receiving pocket having a pocket receiving opening for receiving a card is formed on the outer side of the actuation means and/or on the outer side of the receiving device remote from the actuation means, wherein the receiving pocket comprises at least one engagement opening. A card received in the receiving pocket can be touched through the engagement opening, preferably an edge of the card located in the receiving pocket can be touched with at least one finger through the engagement opening or can be pushed out of the receiving pocket by manually applying a pressure force on the card through the engagement opening, in particular on the edge of the card. At least one engagement opening is formed for example in a corner region of the card holder in which the shaft for the rotational movement of the actuation means relative to the receiving device is arranged. Alternatively or in addition, the at least one engagement opening can be formed in a corner region of the card holder which is arranged, in the initial position of the card holder, on a side opposite the receiving opening of the receiving device and a side, in particular short side of the main extension surface of the card holder, opposite the shaft. Alternatively or in addition, at least one engagement opening can be formed at a side region of the card holder which is arranged, in the initial position of the card holder, on a side opposite the receiving opening of the receiving device.

In other words, the receiving pocket can be arranged or formed at a main extension surface of the actuation means and/or at a main extension surface of the receiving device. The receiving pocket can for example be designed such that it is configured for receiving coins and/or for receiving a transmitting device (e.g. an AirTag) and/or for receiving at least one card. For example, the receiving pocket is configured, or is of corresponding dimensions, for receiving at least one, preferably a single, card, e.g. a card in a credit card format or a similar card format. The at least one receiving pocket can be arranged or formed in a manner placed on the main extension surface of the receiving device and/or on the main extension surface of the actuation means. Optionally, an engagement opening can be formed on an outer skin of the receiving pocket or on the pocket cover of the receiving pocket, which opening makes it possible to push out a card, inserted in the receiving pocket, in the direction of a pocket receiving opening, by direct contact through the engagement opening. In other words, the engagement opening forms an opening through which the interior of the receiving pocket-besides a pocket receiving opening through which the card can be inserted into and removed from the receiving pocket—is accessible from the outside. However, the at least one engagement opening is dimensioned in such a way that a card, in particular a card in a credit card format or EC card format, cannot be guided therethrough. The pocket receiving opening forms the single opening of the receiving pocket, in order to receive a card in the interior of the receiving pocket, at least in portions. The engagement opening can be designed in such a way that, in the state of a card when inserted as intended into the receiving pocket, in particular a card corresponding to a credit card format, said card is visible from outside, through the engagement opening. Preferably, in the state of a card fully inserted into the receiving pocket, in particular a card corresponding to a credit card format, an edge of the card is exposed or is freely accessible via the engagement opening, such that the card can be pushed out of the through-opening by application of pressure on said edge of the card, in particular direct application of pressure, in particular occurring manually by means of a finger.

In a preferred embodiment, the engagement opening can be arranged or formed in a corner region and/or in a central or middle region of a receiving pocket having a rectangular basic shape. The engagement opening is preferably arranged or formed at an end region, in particular corner region or central region, of the receiving pocket opposite the pocket receiving opening. In a particularly preferred embodiment it can be provided that at least one engagement opening is arranged in a corner region of the receiving pocket in which the pivot shaft is also located, and thus a pressure, in particular introduced in parallel with the main extension plane of the actuation means, from outside can be favorably introduced in the direction of the center of the card holder, without or with barely any evasive movement of the actuation means about the pivot shaft. In other words, the fact that the pivot shaft and at least one push-out opening are located in the same corner region means that a relative twisting of the actuation means and receiving device can be prevented, or at least kept low, when a pressure force is applied through said engagement opening onto a card arranged in the receiving pocket.

It is possible that a slip agent is arranged or formed at least in portions, preferably largely, particularly preferably completely (a) at, in particular on, a surface of the front plate facing the actuation means, and/or (b) at, in particular on, a region, facing the actuation means, of a connection means connecting the front plate to the main body, e.g. a screw head, and/or (c) at, in particular on, a surface of the actuation means facing the front plate and/or the main body. The slip agent can serve to achieve smooth running and/or to prevent scratching on account of contact surfaces of the actuation means and the receiving device, in particular of the front plate, during the relative movement of the actuation means and front plate or while an actuating movement of the front plate and the receiving device is performed. For example, a coating and/or a film is arranged on the side of the actuation means facing the receiving device and/or on the side of the receiving device, in particular the front plate, facing the actuation means. The slip agent can for example be fastened to the actuation means and/or to the receiving device, in particular to the front plate and/or the connection means, in a force-fitting and/or form-fitting and/or integral manner. For example, at least or exclusively the surface portion of the actuation means is provided at least in portions, preferably largely, particularly preferably completely, with a slip agent which, during the maximum actuating movement, remains overlapping with the receiving device or does not protrude beyond the limit of the receiving device. It is possible for the slip agent to be formed of plastics material, in particular of a thermoplastic material and/or of polyester, or to comprise such a material. For example, the slip agent is made of polyethylene terephthalate (PET) or contains this as a component. In particular, a PET foil can be used. This can be adhesively bonded to a surface of the actuation means and/or a surface of the receiving device.

BRIEF DESCRIPTION OF THE DRAWINGS

The invention is explained in greater detail on the basis of embodiments shown in the drawings, in which drawings.

DETAILED DESCRIPTION OF THE INVENTION

Figure 1:
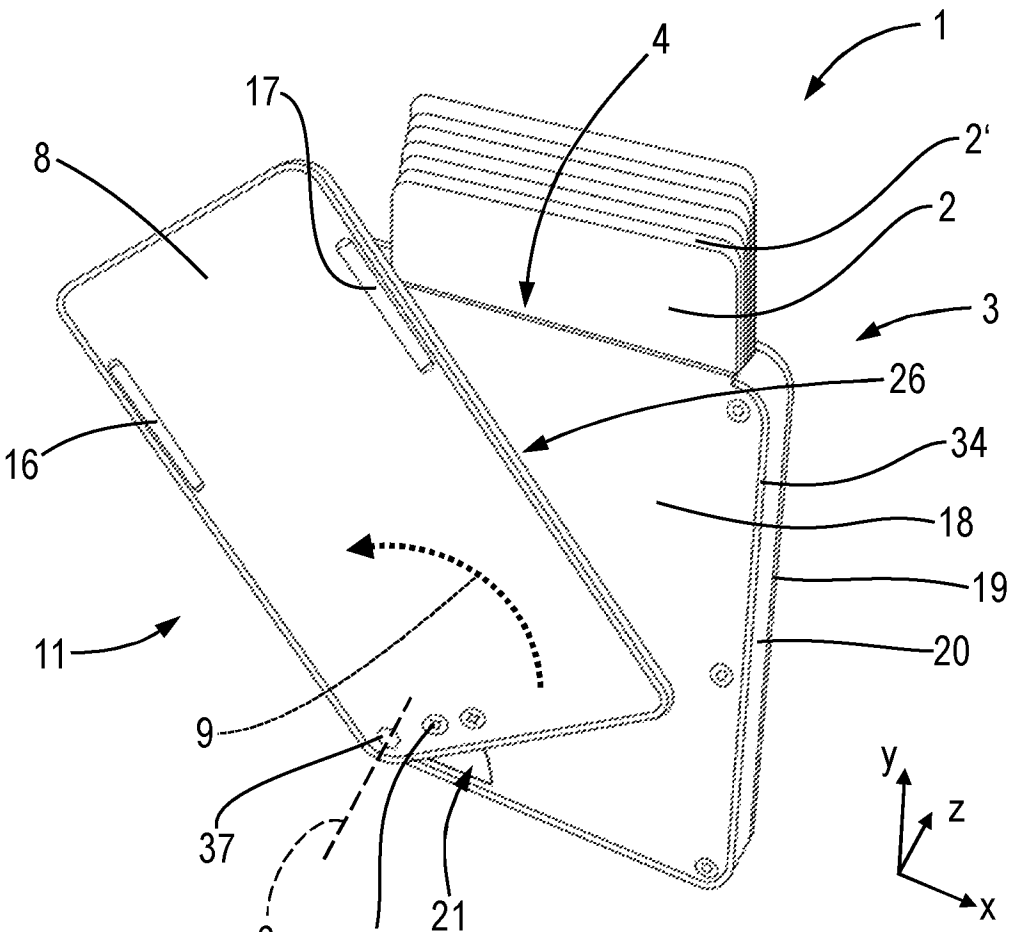
FIG. 1 is a perspective schematic view of a card holder according to an embodiment.

In the figures, an embodiment of a card holder 1, in particular (card) wallet, for holding or receiving at least one card 2, 2', in particular a card 2, 2' corresponding to a credit card format, is shown. The card holder 1 comprises a receiving device 3 having a receiving opening 4 and an interior 5, wherein at least one card 2, 2' can be received, in particular completely, in the interior 5 via the receiving opening 4. For this purpose, the interior 5 can form a cuboid cavity, which is adjusted to the dimensioning of the cards to be received, in particular the shape of a credit card, EC card or similar cards. At least one ejection means 7, also referred to as ejector 7, which is arranged in the interior 5, in a manner mounted so as to be rotatable about a shaft 6, indirectly or directly. The ejection means 7, visible for example in FIGS. 4 and 5, can be designed in the manner of a rotatably mounted finger, which moves or pushes out of the interior 5, at least in portions, by direct contact with the cards arranged in the interior 5, in the case of actuation of an actuation means 8, also referred to as actuator 8.

The card holder 1 comprises at least one actuation means 8 which is connected to the ejection means 7 in a motion-coupled manner and is mounted so as to be rotatable about a shaft 6. The actuation means 8 can be designed as a grip or as an element to be actuated directly by a user of the card holder by muscle force, and in particular thus to be touched directly. By performing an actuating movement 9, indicated by way of example in FIG. 1, of the actuation means 8 relative to the receiving device 3 from an initial position 10 to an output position 11 at least one card 2, 2' arranged in the receiving device 3, in particular all the cards 2, 2' stored in the interior 5, are moved out of the interior 5, at least in part, via the receiving opening 4.

The receiving device 3 can for example have a prismatic basic shape, in particular a cuboid basic shape, and the actuation means 8 can be designed for example as a planar body, wherein a main extension surface 12, 13 of the actuation means 8 is of a size which corresponds at least to 35%, preferably to at least 50%, particularly preferably to at least 75%, most preferably to at least 85%, more preferably completely, to the size of a main extension surface 12 of the receiving device 3. In other words, the actuation means 8 can be of a size, in particular a maximum planar extension, which substantially corresponds to the size, in particular the maximum planar extension, of the receiving device 3.

Figure 3:
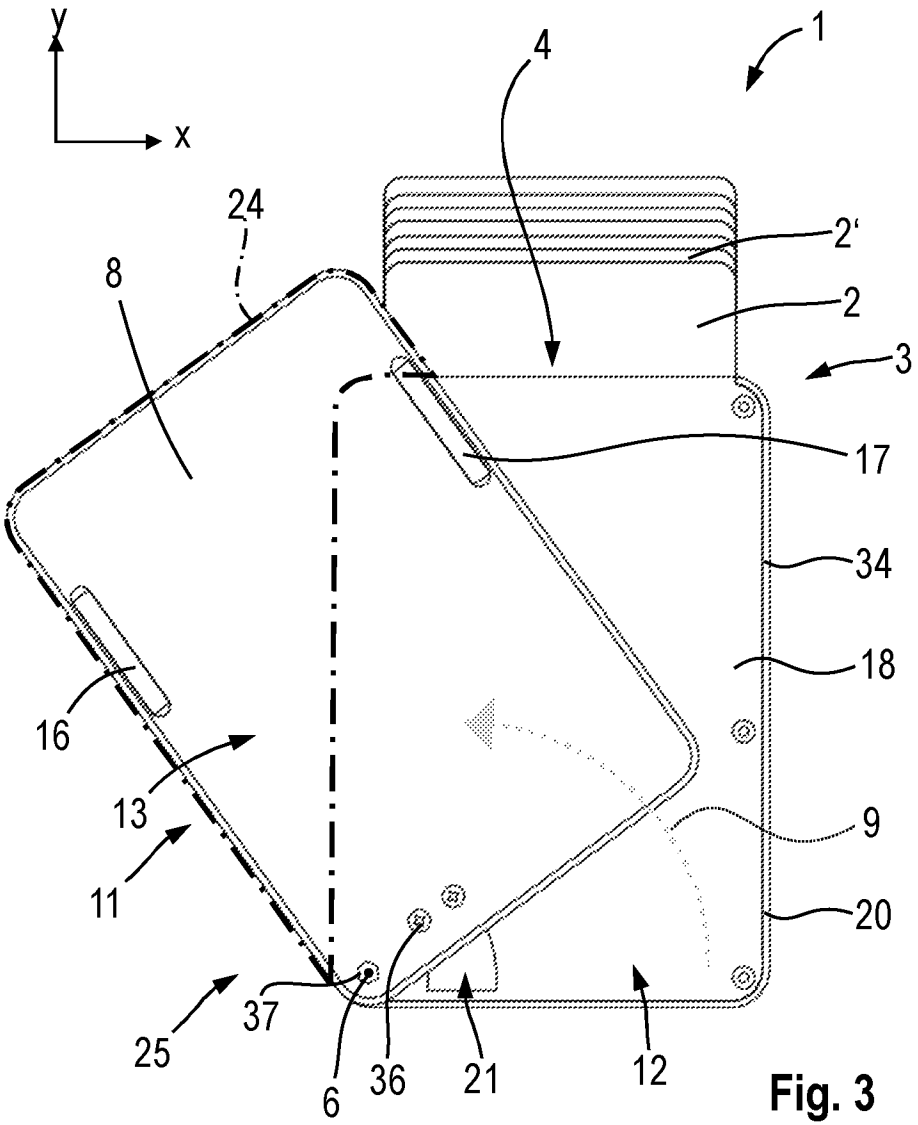
FIG. 3 is a schematic front view of a card holder according to FIG. 2 comprising an actuation means located in an output position.
Figure 2:
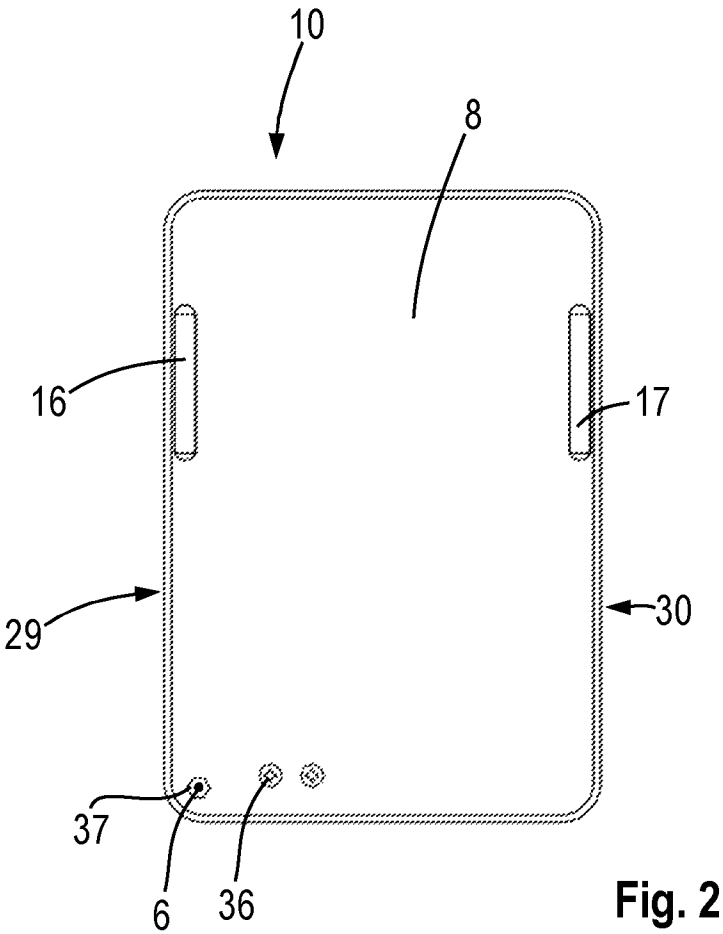
FIG. 2 is a schematic front view of a card holder comprising an actuation means located in an initial position, according to one embodiment.

As can be seen for example from FIG. 2, the actuation means 8 can be arranged, in the initial position 10, in particular in a rest position, so as to be largely, preferably completely, congruent with a main extension surface 12 of the receiving device 3. The actuation means 8 can furthermore protrude, in the output position 11, beyond a main extension surface 12 of the receiving device 3, at least in part, cf. FIG. 3. The exposed surface region of the receiving device 3 under the actuation means 8 that has been pivoted away or pivoted out can be used as a notes surface, for example for notes to be made using a pencil. When the actuation means 8 is pivoted back into its initial position, the note is protected against mechanical influences by arranging the actuation means 8 over the note. Alternatively or in addition, a note can be made on the rear side of the planar actuation means 8, and for this purpose a note can be made on the surface of the actuation means 8 protruding beyond the main extension surface 12 of the receiving device 3. When the actuation means 8 is pivoted back into its initial position, the note is screened or protected by the receiving device 3.

The actuation means 8 can be able to be held for example in at least one output position 11 rotated out of the initial position 10, in particular in the maximally rotated-out end state position, by a holding device (not shown), in the rotated-out output position 11, against a preload force generated by a preload means 14, in particular a spring preload means, which preloads the actuation means 8 into the initial position 10. For example, the ejection means 7 and/or the actuation means 8 and/or the receiving device 3, in particular the intermediate element 20, comprises a latching structure (not shown) which allows for the actuation means 8 to be held in a latching manner in at least one predefined rotational position of the actuation means 8 relative to the receiving device 3.

The actuation means 8 can for example protrude beyond a main extension surface 12 of the receiving device 3 in at least one position, rotated out of an initial position 10, in particular a rest position, relative to the receiving device 3, preferably an output position 11, particularly preferably in a position achieved in an end state of the actuating movement 9, wherein a surface portion 24 of the actuation means 8 which protrudes beyond the main extension surface 12 of the receiving device 3 in this case corresponds to at least 10%, preferably at least 20%, particularly preferably at least 35%, most preferably at least 50%, of the main extension surface 13 of the actuation means 8. The protruding surface portion 24 of the actuation means 8 can be written on, on the surface thereof facing the receiving device 3, during its protrusion.

Alternatively or in addition, said surface can be used for arranging a marking, since said portion is not visible in the initial position of the actuation means 8.

Figure 5:
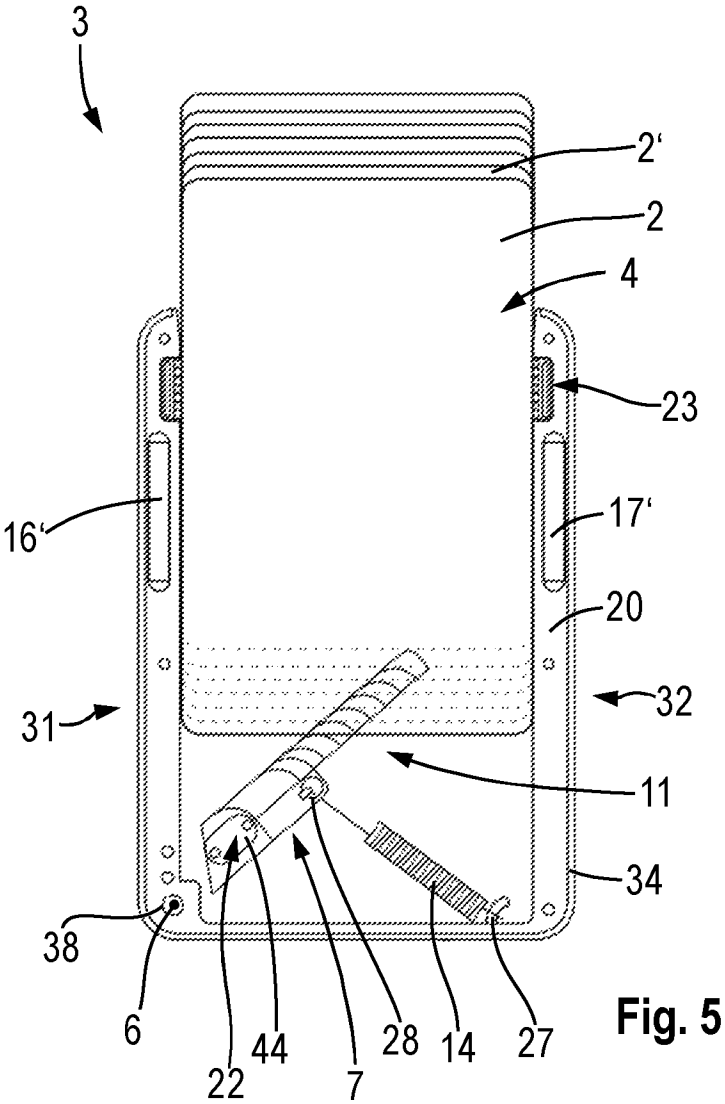
FIG. 5 is a schematic front view of a card holder according to FIG. 4 in an output position of the ejection means.
Figure 4:
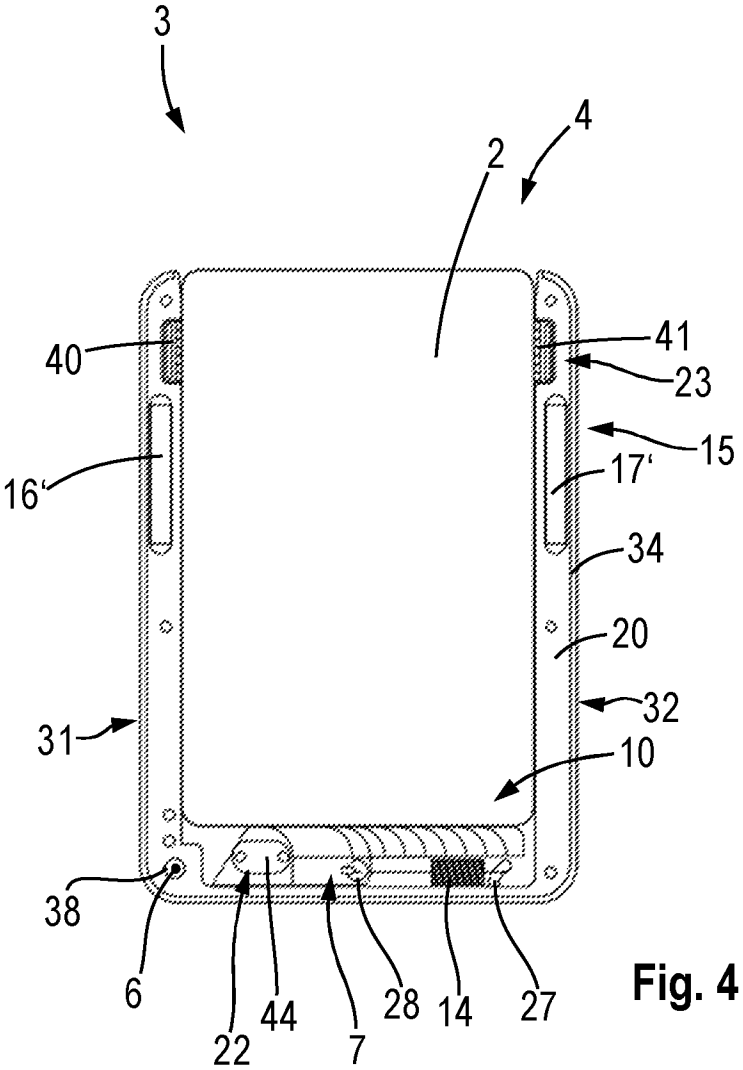
FIG. 4 is a schematic front view of a card holder comprising a front plate (not shown) and actuation means (not shown) in an initial position of the ejection means, according to one embodiment.
Figure 7:
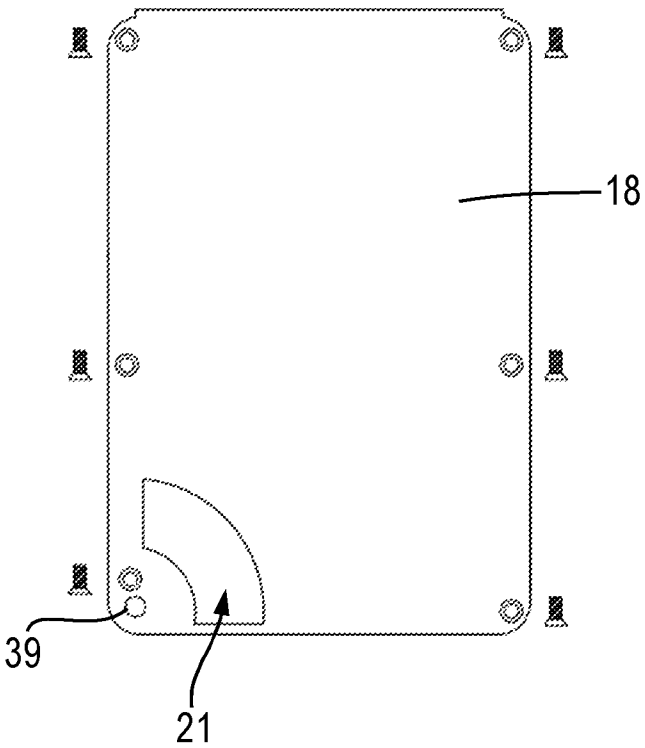
FIG. 7 is a schematic view of a front plate together with fastening means for fixing the front plate to an intermediate element.
Figure 6:
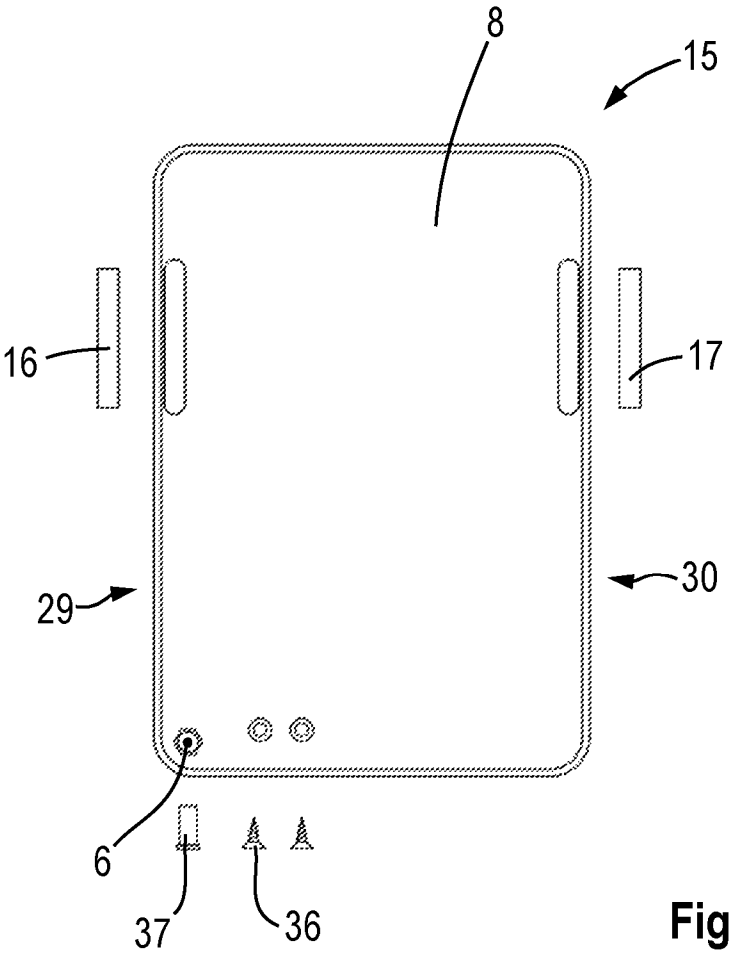
FIG. 6 is a schematic exploded view of an actuation means together with fastening means, a shaft body, and magnet elements.
Figure 8:
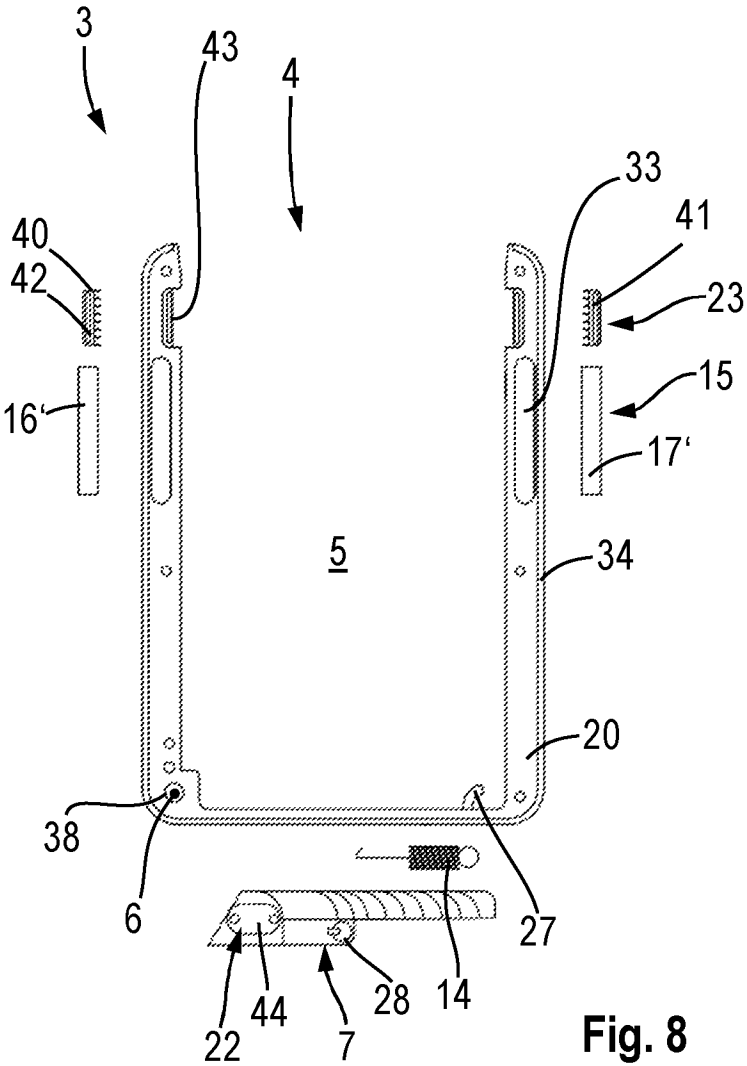
FIG. 8 is a schematic exploded view of an intermediate element together with magnet elements, a retaining device, an ejection means, and a (spring) preload means, according to one embodiment.

FIGS. 4, 5 and 8 each show a preload means 14, in particular a spring preload means, which preloads the actuation means 8 relative to the receiving device 3, into the initial position 10, by means of a preload force. For this purpose, the preload means 14, in particular spring preload means, is fastened at one end on a fastening element 27, e.g. a hook, on the receiving device 3, in particular on an intermediate element 20, and at the other end on a fastening element 28, e.g. a hook, on the ejection means 7 and/or on the actuation means 8.

Furthermore, the card holder 1 optionally comprises a magnet device 15, wherein the magnet device 15 pushes or preloads the receiving device 3 and the actuation means 8 in at least one predefined orientation relative to one another on account of magnetic forces. Said predefined orientation of the receiving device 3 and the actuation means 8 preferably corresponds to the initial position 10.

Figure 9:
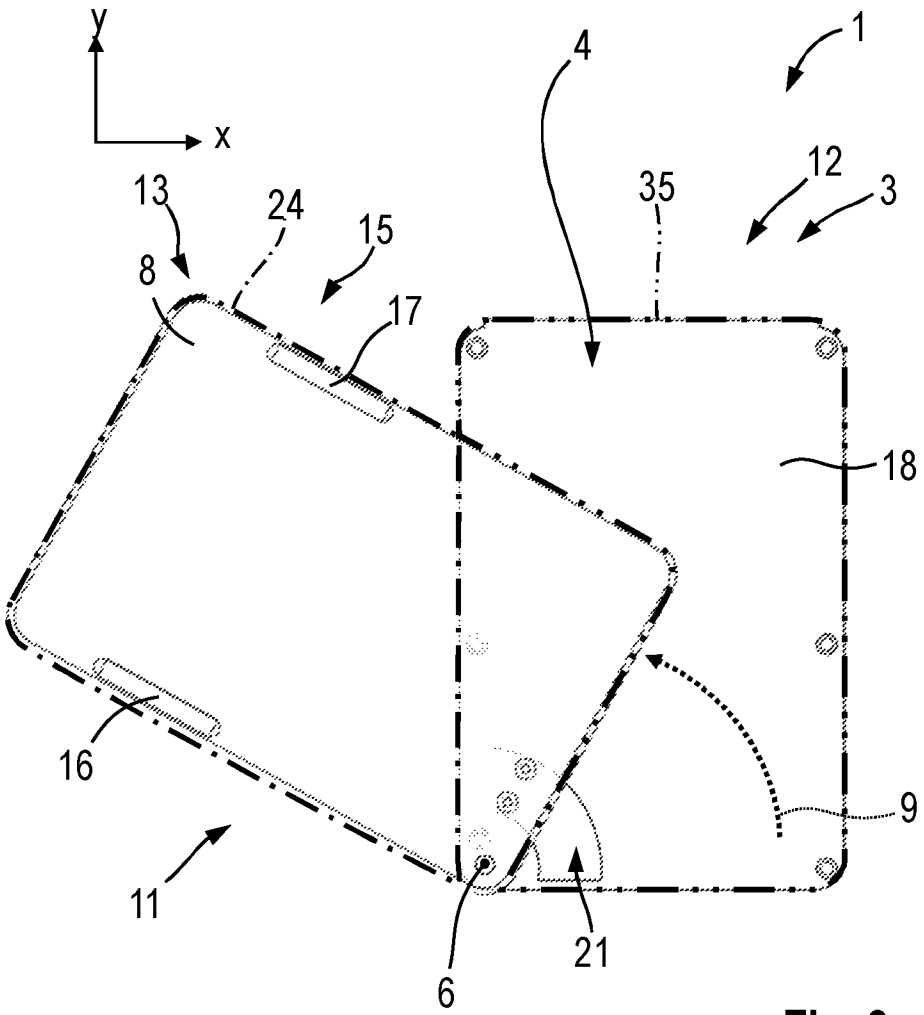
FIG. 9 is a schematic view of a card holder comprising an actuation means located in an end position and shown in a partially transparent manner, according to one embodiment.

The magnet device 15 can for example comprise at least one pair of magnet elements 16, 16', 17, 17', wherein a first magnet element 16 is arranged or formed on the actuation means 8 and a second magnet element 16', associated with the first magnet element 16, is arranged or formed on the receiving device 3. The magnet device 15 can optionally comprise a further pair of magnet elements 17, 17', wherein a third magnet element 17 is arranged or formed on the actuation means 8 and a fourth magnet element 17', associated with the third magnet element 17, is arranged or formed on the receiving device 3. In FIGS. 8 and 9, the magnet elements 16, 16', 17, 17' are shown by way of example as elongate magnet elements 16, 16', 17, 17', wherein a first magnet element 16 is arranged or formed on a first long side edge of the actuation means 8, and a third magnet element 17 is arranged or formed on a long side edge of the actuation means 8 opposite the first long side edge. The magnet elements 16, 17 are preferably fastened to the actuation means 8 in a force-fitting and/or integral and/or form-fitting manner. The receiving device 3 comprises, on a first long side edge, a second magnet element 16' that is associated with the first magnet element 16, and the receiving device 3 further comprises, on a second long side edge opposite the first long side edge, a fourth magnet element 17' which is associated with the third magnet element 17 on the actuation means side. The receiving device 3 can for example comprise receiving spaces 33 in which the magnet elements 16, 17 on the receiving device side can be received at least in portions, preferably completely. For example, the magnet elements 16, 17 can be received in a receiving space 33, in each case, of the receiving device 3 under action of a clamping force. The receiving device 3 can comprise an intermediate element 20, in particular designed in a U-shape, on which the magnet elements 16, 17 on the receiving device side are arranged or formed, preferably directly.

The magnet device 15 and the preload means 14, in particular spring preload means, can preferably act on the actuation means 8 and the receiving device 3 in such a way as to achieve that the actuation means 8 and receiving device 3 reach and/or remain in the initial position 10, in particular in the rest position. FIG. 4 shows the ejection means 7, and thus the actuation means 8 that is rigidly connected to the ejection means 7, in the initial position 10 or in a rest position. The preload means 14, in particular spring preload means, pushes the ejection means 7 into said position. Furthermore, in this position the magnet elements 16, 16', 17, 17' of the actuation means 8 and of the receiving device 3 are congruent, such that the magnetic forces provide a preload force, on account of attractive forces, also for remaining in this position.

The receiving device 3 can for example comprise a plate-like or plate-shaped front element 18 and/or a plate-like or plate-shaped rear element 19, as well as an in particular planar intermediate element 20 arranged between the front and/or the rear element 19, wherein the intermediate element 20 is U-shaped and the interior 5 is formed or delimited by the intermediate element 20 and the adjacent front and rear element 18, 19. Thus, the receiving device 3 can have a sandwich-like structure, in which the intermediate element 20 is delimited at its main extension surface by the front and rear element 18, 19. It is possible for the intermediate element 20 to comprise an edge stop 34 designed as an elevation, such that the front and/or rear element 18, 19 can be brought into abutment with the edge stop 34. This facilitates the orientation and/or centering of the front and/or rear element 18, 19 relative to the intermediate element 20. The edge stop 34 can for example end flush with the front and/or rear element in the final mounting state. Thus, a step can be formed by means of the edge stop 34, the step height of which step (in the Z-direction) substantially corresponds to the thickness or the material thickness of the front and/or rear element 18, 19, such that a flush termination in the final mounting state is achieved.

The receiving device 3 can for example comprise a plate-like or planar front element 18 which is arranged or formed between the interior 5 and the actuation means 8, wherein the actuation means 8 covers, in particular completely covers, a surface portion 35 of the front element 18 in the initial position 10, and said surface portion 35 of the front element 18 is exposed at least in portions, preferably largely, while the actuating movement 9 is performed. Said surface portion 35 of the front element 18 which is covered in the initial position 10 and exposed in the output position 11 can be used as a board or a writing surface. Alternatively or in addition, a sticker or information applied on another manner (e.g. by means of printing) can be arranged on the front element 18. Alternatively or in addition, the side of the actuation means 8 facing the front element 18 can be used as a board or as a writing surface and/or for placing a sticker or information applied in another manner (e.g. by means of printing).

It is possible for a, possibly slot-like or slot-shaped, recess 21 to be formed in the front element 19, in which recess a connection region 22 on the actuation means side for connection of the actuation means 8 to the ejection means 7 is arranged, and/or in which recess a connection region 22 on the ejection means side for connection of the actuation means 8 to the ejection means 7 is arranged. In the embodiment shown in the drawings, the ejection means 7 comprises an elevation 44 extending in the Z-direction, i.e. perpendicularly to the main extension plane of the front element 19. Said elevation 44 forms the connection region 22 which, in the final mounting state, passes through the recess 21 and connects the ejection means 7 to the actuation means 8. For this purpose, by way of example two fastening elements 36 are used, which engage in the ejection means 7 from the outside, via the actuation means 8. For example, the fastening elements 36 engage through recesses of the actuation means 8 at least in portions, and are arranged in the connection region 22, at least in portions, and are connected to the elevation 44 of the ejection means 7. The use of two fastening means 36 for fastening the ejection means 7 to the actuation means 7 makes it possible for a torsion-proof connection of these two connection partners to be achieved. A shaft body 37 can be fastened to the actuation means 8, in particular by means of a press-fit, which shaft body engages in a shaft body receptacle 38 of the receiving device 3, in particular of the intermediate element 20, and is preferably rotatably mounted there. In this case, the shaft body 37 passes through a passage opening 39 of the front element 18 provided for the shaft body 37.

The ejection means 7 is connected to the receiving device 3 in a supporting manner, for example exclusively via the actuation means 8. The ejection means 7 is thus rotatably mounted on the receiving device 3 via the mounting of the shaft body 37 on the actuation means side with the shaft body receptacle 38 on the receiving device side.

The ejection means 7 can preferably comprise a stepped contact portion 23 for contact of at least two cards 2, 2' received in the interior 5, wherein during the actuating movement 9 the stepped contact portion 23 moves the at least two cards 2, 2' out in a stepped form. For this purpose, a first step of the stepped ejection means 7 can apply a pressure force to a first card 2 and move said card out of the interior 5, and a further step of the stepped ejection means 7 can apply a pressure force to a further card 2' and move said card out of the interior, during the actuating movement 9 of the ejection means 7.

The receiving device 3 can for example comprise a retaining device 23 which forms a force-fitting connection between at least one card 2, 2' introduced into the interior 5 and the receiving device 3. In the embodiment of the card holder 1 shown in the drawings, the retaining device 23 comprises two retaining means 40, 41. In each case at least one retaining means 40, 41 can for example be arranged or formed at, in particular in or on, the receiving device 3 in such a way that cards 2, 2' located in the interior 5 are in each case acted on by at least one retaining means 40, 41 on their opposing narrow sides (the surfaces which extend in the Z-Y plane). At least one retaining means 40, 41 can be fastened in a force-fitting and/or integral and/or form-fitting manner to the receiving device 3, in particular to an intermediate element 20. Preferably, at least one retaining means 40, 41 comprises a recess 42 into which a pin 43 on the receiving device side engages and thus forms a form-fitting connection between the retaining means 40, 41 and the receiving device 3, cf. FIG. 8. Alternatively or in addition, a pin body can also be arranged or formed on the retaining means 40, 41, and the corresponding recess for receiving the pin body can be arranged or formed at the receiving device 3.

It is possible for the card holder 1 to comprise at least one closure device (not shown), wherein the closure device can be designed such that a closure element (not shown) can be moved from a closure position which closes the receiving opening 4 at least in portions to a release position which releases the receiving opening 4. For example, the closure means can be able to be fixed in the release position or in the closure position, or can be movably mounted by means of a latching mechanism in such a way that the release position and/or the closure position can be left only after a defined holding force has been overcome.

It can be seen from the figures that the card holder 1 can for example have a rectangular base surface, wherein a form-fitting connection of the actuation means 8 and the receiving device 3 is formed exclusively at a corner region 25 of the rectangular base surface, and the actuation means 8 together with the receiving device 3 forms a separation gap 26. In other words, the rotatable mounting, which mounts the actuation means 8 in a rotatable manner on the receiving device 3, can be arranged in a corner region 25 of the card holder 1, in particular of the receiving device 3. Preferably, the corner region 25 is arranged or formed in a corner within a rectangular basic shape formed in the X-Y plane. In all embodiments, the pivot shaft or the shaft 6 about which, in particular exclusively, a rotational movement of the actuation means 8 relative to the receiving device 3 takes place can be oriented so as to be in parallel with the Z-direction and thus perpendicular to the X-Y plane.

Figure 11:
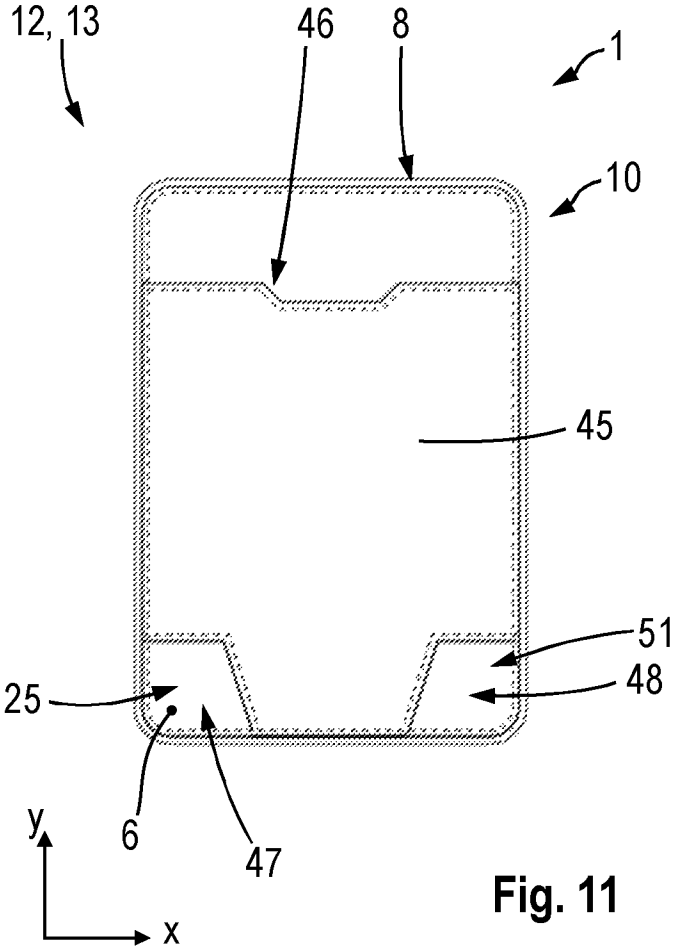
FIG. 11 is a schematic view of a front side of an actuation means provided with a receiving pocket, according to one embodiment.
Figure 12:
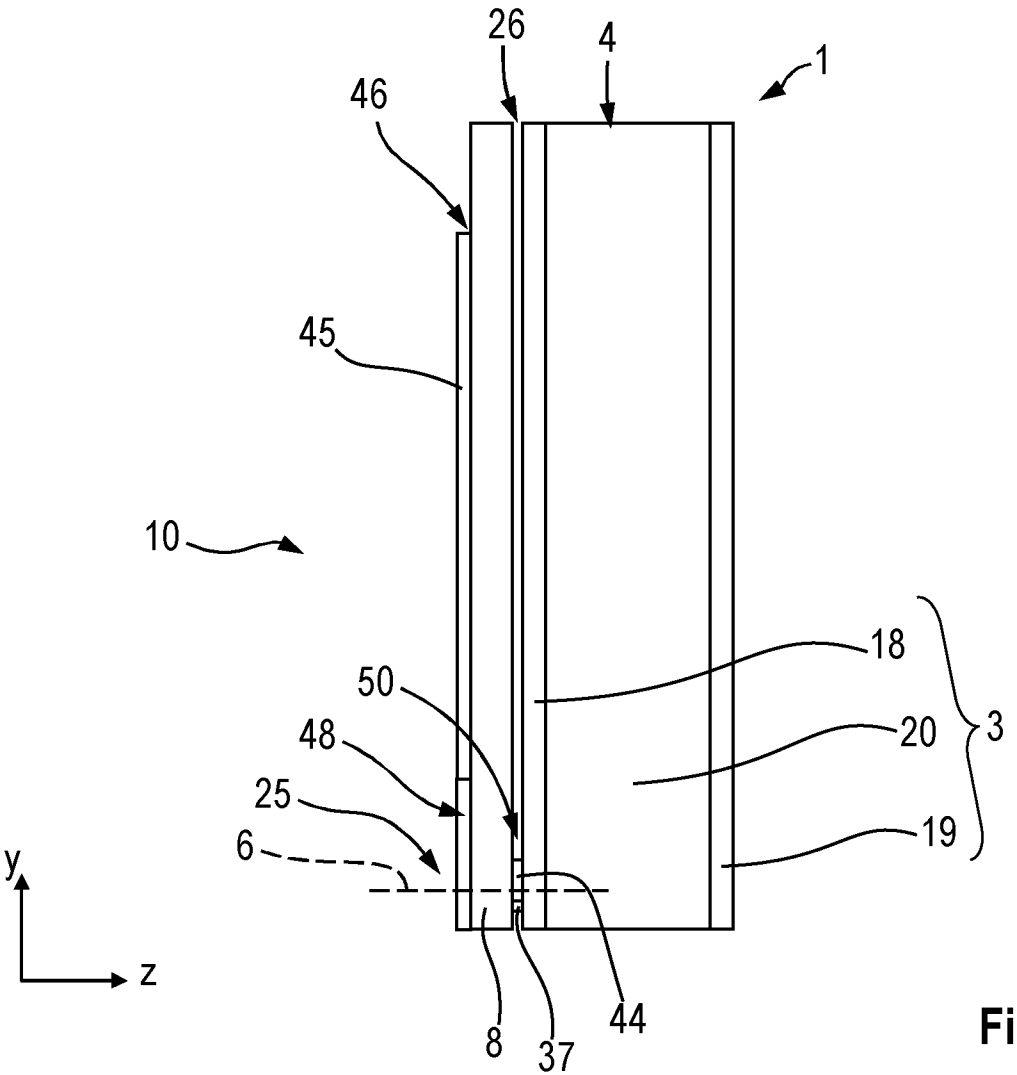
FIG. 12 is a schematic view of the card holder according to FIG. 11 in a side view from the right.

In FIG. 11, the separation gap 26 or the gap space formed between the receiving device 3 and the actuation means 3 is visible. For example, a piece of paper or another planar element (e.g. a banknote) can be placed in the separation gap 26 between the actuation means 8 and the front element 18, e.g. front disk or front plate, facing the actuation means 8. A planar element arranged in the separation gap 26 is held in a clamped manner by the magnetic attractive forces of the magnet device 15, since the magnet device 15 attracts the actuation means 8 to the receiving device 3. The separation gap 26 can extend over at least 50%, preferably at least 75%, particularly preferably at least 85%, most preferably at least 90%, of the main extension surface of the receiving device 3 and/or of the actuation means 8. It is particularly advantageous if, as shown in FIG. 12, the interference geometries 50 interrupting the separation gap 26 are located exclusively in an end half, preferably in an end third, particularly preferably in an end quarter, most preferably in an end sixth, more preferably in an end eighth, more preferably in an end tenth, of the longitudinal extension of the card holder 1 (in the Y-direction). Alternatively or in addition, it can be provided that the interference geometries 50 interrupting the separation gap 26 are located exclusively in an end half, preferably in an end third, particularly preferably in an end quarter, most preferably in an end sixth, of the width extension of the card holder 1 (in the X-direction). Thus, a separation gap 26 that is accessible from a plurality of sides and simultaneously has a large continuous surface area is achieved. The interference geometry 50 is formed for example by the shaft body 37 forming the rotational shaft 6 and/or by a region of the actuation means 8 and/or of the ejection means 7 passing through the recess 21. For example, the rotational shaft 6 can be located at an end third, preferably an end quarter, particularly preferably an end sixth, most preferably an end eighth, more preferably an end tenth, of the longitudinal and/or width extension (a) of the card holder 1 or the receiving device 4 and/or (b) of the actuation means 8.

Figure 10:
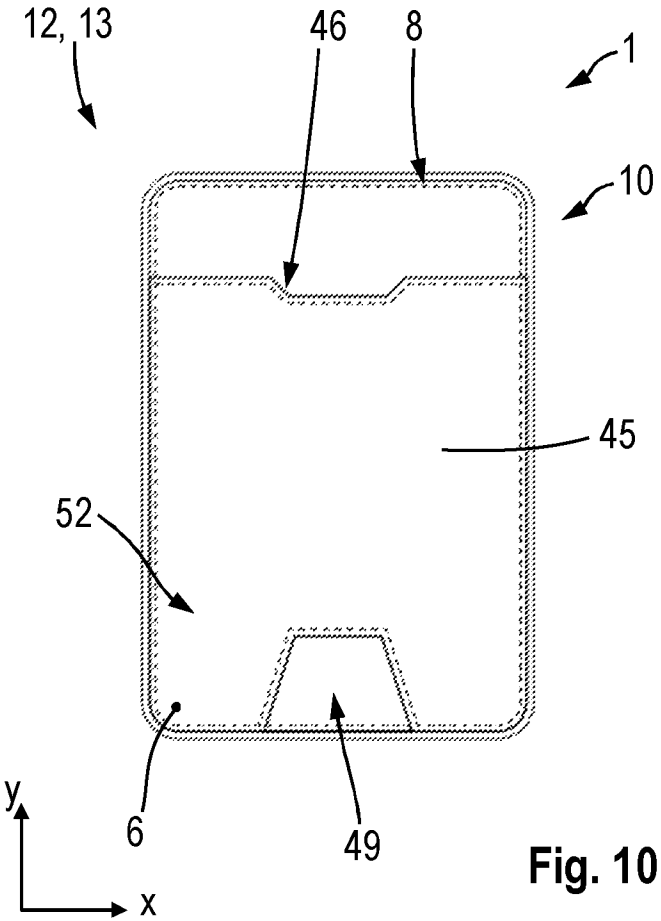
FIG. 10 is a schematic view of a front side of an actuation means provided with a receiving pocket, according to one embodiment.

FIGS. 10 and 11 show embodiments of card holders 1 which are designed having a receiving pocket 45 having a pocket receiving opening 46 for receiving a card 2 on the outer side of the actuation means 8 and/or on the outer side of the receiving device 3 remote from the actuation means 8. The receiving pocket 45 comprises at least one engagement opening 47, 48, 49, through which a card 2, 2' that is inserted at least fully in the receiving pocket 45, as intended, and received therein, can be touched. As shown in FIG. 11, at least one engagement opening 47 can be formed in a corner region 25 of the card holder 1 in which the shaft 6 for the rotational movement of the actuation means 8 relative to the receiving device 3 is arranged. Furthermore, alternatively or in addition an engagement opening 48 can be formed in a corner region 51 of the card holder 1 which is arranged, in the initial position 10 of the card holder 1, on a side opposite the receiving opening 4 of the receiving device 3 and a side, in particular short side of the card holder 1, opposite the shaft 6, cf. FIG. 11. Alternatively, an engagement opening 49 can be arranged or formed at a side region 52 of the card holder 1 which is located, in the initial position 10 of the card holder 1, on a side opposite the receiving opening 4 of the receiving device 3.

LIST OF REFERENCE SIGNS

1 card holder
2, 2' card
3 receiving device
4 receiving opening of 3
5 interior of 3
6 shaft
7 ejection means
8 actuation means
9 actuating movement
10 initial position
11 output position
12 main extension surface of 3
13 main extension surface of 8
14 preload means
15 magnet device
16, 16' magnet element (first and second)
17, 17' magnet element (third and fourth)
18 front element
19 rear element
20 intermediate element
21 recess of 18, 19
22 connection region of 7, 8
23 retaining device
24 protruding surface portion of 8
25 corner region
26 separation gap
27 fastening element on 3 or on 20
28 fastening element on 7 and/or on 8
29 first long side edge of 8
30 second long side edge of 8
31 first long side edge of 3 or 20
32 second long side edge of 3 or 20
33 receiving space of 3 or 20
34 edge stop
35 surface portion of 18
36 fastening element for fastening 7 and 8
37 shaft body
38 shaft body receptacle of 3 or 20
39 passage opening of 18
40 first retaining means of 23
41 further retaining means of 23
42 recess of 40, 41
43 pin of 3
44 elevation of 7
45 receiving pocket
46 pocket receiving opening of 45
47 engagement opening
48 engagement opening
49 engagement opening
50 interference geometry
51 corner region
52 side region

What is claimed is:

1. A card holder (1) for holding at least one card (2, 2') comprising a receiving device (3) having a receiving opening (4) and an interior (5), wherein at least one card (2, 2') can be received in the interior (5) via the receiving opening (4), at least one ejector (7) which is arranged in the interior (5) and is mounted so as to be rotatable, and at least one actuator (8) which is operatively connected to the ejector (7) and is mounted so as to be rotatable about a shaft (6) in an actuating movement (9) relative to the receiving device (3) from an initial position (10) to an output position (11), wherein the at least one card (2, 2') arranged in the receiving device (3) can be moved out of the interior (5), at least in part, via the receiving opening (4), by a rotation of the ejector (7) in response to the actuating movement (9) of the actuator (8) relative to the receiving device (3) from the initial position (10) to the output position (11), wherein the actuator (8), in the initial position (10), does not protrude beyond a main extension surface (12) of the receiving device (3), and at least a part of the actuator (8), in the output position (11), protrudes beyond the main extension surface (12) of the receiving device (3).

2. The card holder (1) according to claim 1, wherein the receiving device (3) has a prismatic basic shape and the actuator (8) is configured as a planar body, wherein a main extension surface (13) of the actuator (8) is of a size which corresponds at least to 35% of the size of the main extension surface (12) of the receiving device (3).

3. The card holder (1) according to claim 1, wherein the actuator (8) is arranged, in the initial position (10), so as to be congruent with the main extension surface (12) of the receiving device (3).

4. The card holder (1) according to claim 1, wherein the actuator (8) protrudes beyond the main extension surface (12) of the receiving device (3) in at least one position rotated out of the initial position (10) relative to the receiving device (3), wherein a surface portion (24) of the actuator (8) which protrudes beyond the main extension surface (12) of the receiving device (3) in this case corresponds to at least 10% of a main extension surface (13) of the actuator (8).

5. The card holder (1) according to claim 1, further comprising a preload spring (14) which preloads the actuator (8) relative to the receiving device (3), into the initial position (10), by means of a preload force.

6. The card holder (1) according to claim 1, further comprising a magnet device (15) that preloads the receiving device (3) and the actuator (8) in at least one predefined orientation relative to one another on account of magnetic forces.

7. The card holder (1) according to claim 6, wherein the magnet device (15) comprises at least one pair of magnet elements (16, 16', 17, 17'), wherein a first magnet element (16) is disposed on the actuator (8) and a second magnet element (16'), associated with the first magnet element (16), is disposed on the receiving device (3).

8. The card holder (1) according to claim 5, further comprising a magnet device (15) that preloads the receiving device (3) and the actuator (8) in at least predefined orientation relative to one another on account of magnetic forces, wherein the magnet device (15) and the preload spring (14) act on the actuator (8) and the receiving device (3) in such a way that the actuator (8) and receiving device (3) reach and/or remain in the initial position (10).

9. The card holder (1) according to claim 1, wherein the receiving device (3) comprises a plate-shaped front element (18), a plate-shaped rear element (19), and an intermediate element (20) arranged between the front element (18) and the rear element (19), wherein the intermediate element (20) is U-shaped and the interior (5) is formed or delimited by the intermediate element (20) and the adjacent front element (18) and rear element (19).

10. The card holder (1) according to claim 1, wherein the receiving device (3) comprises a plate-shaped front element (18) which is disposed between the interior (5) and the actuator (8), wherein the actuator (8) covers a surface portion of the front element (18) in the initial position (10), and the surface portion (35) of the front element (18) is exposed at least in portions while the actuating movement (9) is performed.

11. The card holder (1) according to claim 9, wherein a recess (21) is formed in the front element and/or in the rear element (18, 19), in which recess a connection region (22) on the actuator side for connection of the actuator (8) to the ejector (7) is arranged, and/or in which recess a connection region (22) on the ejector side, for connection of the actuator (8) to the ejector (7) is arranged.

12. The card holder (1) according to claim 1, wherein the ejector (7) is connected to the receiving device (3) in a supporting manner exclusively by the actuator (8).

13. The card holder (1) according to claim 1, wherein the ejector (7) comprises a stepped contact portion (23) for contact of at least two cards (2, 2') received in the interior (5), wherein during the actuating movement (9) the stepped contact portion (23) moves the at least two cards (2, 2') out in a stepped form.

14. The card holder (1) according to claim 1, wherein the receiving device (3) comprises a retaining device (23) which forms a force-fitting connection between the at least one card (2, 2') introduced into the interior (5) and the receiving device (3).

15. The card holder (1) according to claim 1, further comprising a closure device configured to move a closure element between a closure position which closes the receiving opening (4) at least in portions, and a release position which releases the receiving opening (4).

16. The card holder (1) according to claim 1, wherein the card holder (1) has a rectangular base surface, wherein a form-fitting connection of the actuator (8) and the receiving device (3) is formed exclusively at a corner region (25) of the rectangular base surface, and the actuator (8) together with the receiving device (3) forms a separation gap (26).

17. The card holder (1) according to claim 1, wherein the actuator (8) can be held in at least one output position (11) rotated out of the initial position (10) by a holding device, in the rotated-out output position (11), against a preload force generated by a preload spring (14) which preloads the actuation means (8) into the initial position (10).

18. The card holder (1) according to claim 1, further comprising a receiving pocket (45) having a pocket receiving opening (46) for receiving a card (2, 2') is formed on the outer side of the actuator (8) and/or on the outer side of the receiving device (3) remote from the actuator (8), wherein the receiving pocket (45) comprises at least one engagement opening (47, 48, 49) through which a card (2, 2') received in the receiving pocket (45) can be touched, wherein the at least one engagement opening (47, 48, 49) is formed in at least one of

- a corner region (25) of the card holder (1) in which the shaft (6) for the rotational movement of the actuator (8) relative to the receiving device (3) is arranged,
- a corner region (51) of the card holder (1) which is arranged, in the initial position (10) of the card holder (1), on a side opposite the receiving opening (4) of the receiving device (3) and a side, in particular short side, opposite the shaft (6), and
- a side region (52) of the card holder (1) which is arranged, in the initial position (10) of the card holder (1), on a side opposite the receiving opening (4) of the receiving device (3).

19. The card holder (1) according to claim 1, wherein the ejector (7) is fixedly attached to the actuator (8) and both the ejector (7) and the actuator (8) rotate about the shaft (6).

20. The card holder (1) according to claim 1, wherein the actuator (8) is disposed on a front of the receiving device (3) and the main extension surface (12) is an entire surface of the front of the receiving device (3).

* * * * *